US006060708A

United States Patent [19]

Grubner

[11] Patent Number: 6,060,708

[45] Date of Patent: May 9, 2000

[54] CORONA GENERATING DEVICE WITH UNITARY REMOVABLE SHIELD

[75] Inventor: George Grubner, Needham, Mass.

[73] Assignee: Burle Technologies, Inc., Wilmington, Del.

[21] Appl. No.: 09/111,872

[22] Filed: Jul. 8, 1998

[51] Int. Cl.[7] ..... H01T 19/00

[52] U.S. Cl. ..... 250/324; 361/229; 361/230

[58] Field of Search ..... 250/324, 325, 250/326; 355/3 CH, 325, 321; 361/320, 225, 212, 229, 230

[56] References Cited

U.S. PATENT DOCUMENTS 3,794,839 2/1974 Hayne ..... 250/324

5,008,538 4/1991 DeCecca et al. ..... 250/324

*Primary Examiner*—Kiet T. Nguyen

*Attorney, Agent, or Firm*—Watson Cole Grindle Watson, P.L.L.C.

[57] ABSTRACT

A unitary removable shield, serving the same function as a film or coating of electrically conductive material applied over the conductive cavity of a universally adaptable corona generating or charging device, is inserted into the cavity to adsorb and desorb nitrogen oxide species produced by negative corona. The unitary removable shield has a generally U-shaped cross-sectional configuration which fits within the cavity. The shield may be retained in the housing by engaging and conforming to the shape of the conductive cavity in a tight frictional fit so as to make electrical contact with the conductive cavity. The shield may also be retained in the housing by tabs or pressure-loadable clips which engage portions of the housing.

11 Claims, 2 Drawing Sheets

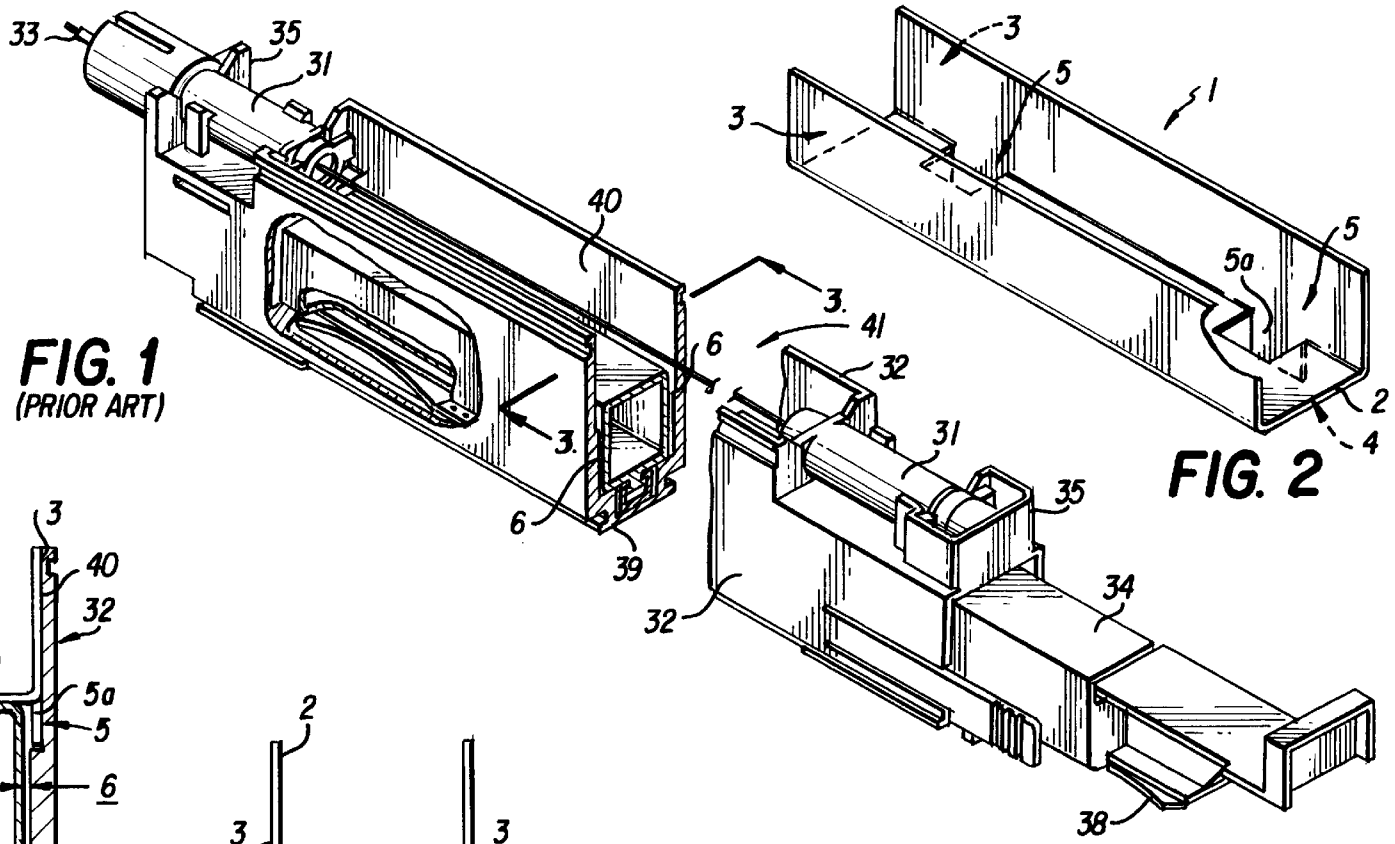
FIG. 1 (PRIOR ART)
FIG. 2
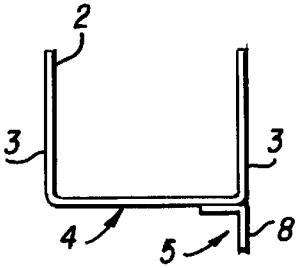
FIG. 4
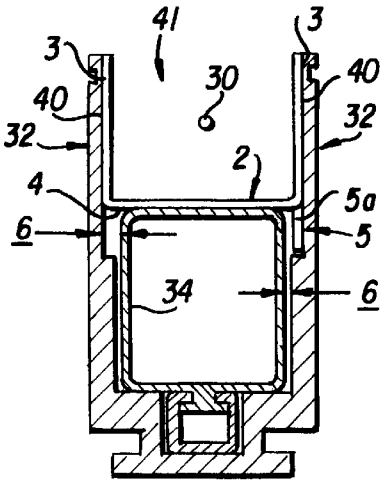
FIG. 3

CORONA GENERATING DEVICE WITH UNITARY REMOVABLE SHIELD

FIELD OF THE INVENTION

The present invention is directed to a corona generating or charging device for use in electrostatographic reproduction devices, and in particular to a unitary removable shield for use in adsorbing and desorbing nitrogen oxide species generated by such a corona generating device.

DESCRIPTION OF RELATED ART

This invention pertains to an improvement over the embodiment of FIG. 2 of U.S. Pat. No. 4,290,266 to Reale, the disclosure of which is hereby incorporated by reference.

As general background, the effects of a negative corona occurring in corona generating devices is discussed so as to comprehensively understand the purpose of this invention. Past known corona generating devices, like those of U.S. Pat. No. 3,908,127 to Clark, U.S. Pat. No. 4,764,675 to Levy et al. and U.S. Pat. No. 3,609,354 to Herman, utilize a conductive shield with a generally U-shaped cross-sectional configuration substantially surrounding the electrode wire. When using corona generating devices, a problem arises in that various nitrogen [] oxide species are produced by the corona. While these nitrogen oxide species are adsorbed by solid surfaces, they have also been observed to be adsorbed by the conductive shield, the housing and various components located within proximity of the corona generating device.

The prior art acknowledges that the adsorption process can be a physically reversible process wherein the nitrogen oxide species once adsorbed by the surrounding components are desorbed gradually when the corona device is powered off for extended periods. However, the composition of the species absorbed may not necessarily be the same as the composition of the nitrogen species desorbed and it is well known that a conversion of $NO_2$ to $HNO_3$ may occur. What occurs in the practical sense is readily observable upon powering on the corona device, wherein a defect in copy quality occurs. Known as a parking deletion, this defect entails a line or band image deletion. Another defect may be noticed when the corona device is powered off and remains idle, in particular, a lower density image may appear across the width of the photoreceptor at a location opposite the corona generating device. An interaction of the nitrogen oxide species with the surface of the photoreceptor is believed to increase the lateral conductivity and thereby render the photoreceptor unable to retain a charge in accordance with an image configuration.

The noticeable effect of the above results in a narrow line or solid area images becoming blurred and appearing washed out, as opposed to being developed as a toner image. Over to extended periods of idleness where the exposure of the photoreceptor to the desorbing nitrogen oxide species occurs, the line defect and solid area deletions have been noticed to increase in severity. For the initial stage of exposure of the photoreceptor to the desorbing nitrogen oxide species, reaction between the photoreceptor and the nitrogen oxide species occurs primarily at the surface. But, after prolonged exposure, the reaction has been noticed to penetrate the surface layer of the photoconductive member. Whereas in the former situation, it may possible to rejuvenate the photoreceptor with a topical cleaning application, it is the latter situation which results in more difficulties when trying to alleviate the situation.

The prior art reveals various solutions to effect adsorption of the nitrogen oxide species and to retard the desorption effect. In FIG. 2 of the U.S. Pat. No. 4,290,266, a dicorotron is disclosed wherein the conductive shield 34 in conjunction with the two vertically extending side panels 32 coated with an aluminum hydroxide electrically conductive film 40 containing particulate graphite and powdered nickel effectively forms a conductive cavity in FIG. 1 of the U.S. Pat. No. 4,290,266. This conductive cavity 41 is represented in FIG.1 of the present invention. This film 40 resides also on conductive shield 34 and adsorbs and desorbs the nitrogen oxide species, to overall neutralize the nitrogen oxide species when they are generated. The use of a film over a conductive shield is also discussed in U.S. Pat. No. 4,646,196 to Reale.

U.S. Pat. No. 5,451,754 to Reale discloses elements forming the composition of the film of a metal or metal composition that is electrically conductive. U.S. Pat. No. 5,539,205 to Reale, U.S. Pat. No. 4,585,322 to Reale, and U.S. Pat. No. 4,585,323 to Ewing et al. describe further compositions and chemistry of such a film used as a conductive coating. The difficulties resulting from a negative corona and the various nitrogen oxide species produced by the corona are not effectively addressed by the prior art and with time and usage, this coating or film degrades thereby rendering ineffectual the adsorbing and desorbing properties of the dry film.

Attempts have been made to alleviate the degradation of this dry conductive film. For example, U.S. Pat. No. 5,485,253 to Osbourne discloses side panels that are pivotally-hinged to allow replacement of the side shields that are a coating applied to the housing sides. Together with the replacement of the base conductive shield, the replacement of side shields helps to prolong the life of the corona and provides relief from parking deletion problems that persist due to the failure of electrodag materials to continue absorbing or forming harmless compounds with the nitrogen oxide species over time. The approach by Osbourne, however, is complicated, expensive and labor intensive. By contrast, the present invention provides an easier solution to replacing the degraded and worn-out shield that substantially surrounds the electrode by inserting a single removable shield unit.

U.S. Pat. No. 5,008,538 to DeCecca et al. discloses a corona charger with conductive shield that is U-shaped in configuration. The charger is of inexpensive construction so it may be discarded when no longer useful. Yet, there is no mention of a removable shield like that of the present invention, which avoids altogether having to discard the corona charger. Instead, the present invention seeks to keep costs low by replacing the worn out conductive film with a drop-in removable shield which can be inexpensively manufactured. The present invention prolongs the useful life of the corona charger rather than discarding the corona charger of the prior art.

SUMMARY OF THE INVENTION

It is an object of this invention to provide a replacement for the conductive coating or film of the prior art which degrades over time and with usage of the corona device. Once the film or coating of the prior art breaks down, the adsorbing and desorbing properties cease to be effective.

To achieve this and other objects, the present invention is directed to a corona generating device with removable shield with a housing and at least one elongated conductive corona discharge electrode supported by the housing. A first conductive shield is supported by the housing and defines a conductive surface on one side of the electrode. The housing includes a pair of sides adjacent the conductive shield and defines a longitudinal opening at the opposite side of the electrode. A removable shield has a body formed of a metal that retards absorption of nitrogen oxide species that are generated when negative corona is produced by the electrode. The body includes a first surface in electrical contact with the conductive surface of the first conductive shield. This body also has a pair of side surfaces disposed adjacent the pair of sides of the housing. The removable shield is capable of being inserted into or removed from the housing through the longitudinal opening. Means for retaining the body in operative position relative to housing are provided.

By using a single unitary shield, degraded electrically conductive film within a conductive cavity may be easily replaced using the removable shield. Moreover, cleaning of the removable shield is convenient during routine maintenance, or during replacement of the dicorotron wires or electrodes.

It is a further object of this invention to eliminate the necessity of removing or disassembling the entire corona generating device or the plastic housing when servicing deteriorated films in the conductive cavity of the corona generating device.

It is yet another object of this invention to utilize a shield with housings having sides that are either coated with an electrically conductive film or uncoated.

It is a still further object of this invention to provide a removable shield that is inexpensive and easy to manufacture or produce. The removable shield should be of a suitable thickness so that it is bendable into a generally U-shaped cross-sectional configuration, but not so thin so as to comprise a foil and be unable to frictionally engage the conductive cavity while maintaining its physical integrity and shape.

By placing the removable shield in and conforming to the shape of the conductive cavity, in which the coating or film has degraded over time and with usage of the corona charging device, this invention prolongs the life and usage of the original corona generating device in a simplified manner.

Other objects and advantages will be apparent from the specification and drawings which follow.

BRIEF DESCRIPTION OF THE DRAWINGS

FIG. 1 is a perspective view of the prior art showing a corona charging device, in particular, a dicorotron.

FIG. 2 shows a perspective view of the removable shield according to the present invention.

FIG. 3 is a cross-sectional view taken along line 3—3 of the dicorotron of FIG. 1 with the removable shield of the present invention inserted into the conductive cavity.

FIG. 4 is a cross-sectional view of another embodiment of the removable shield including means to retain the shield in operative position relative to the housing in the form of plural tab means attached to the body of the shield.

DETAILED DESCRIPTION OF THE INVENTION

Figure 5:
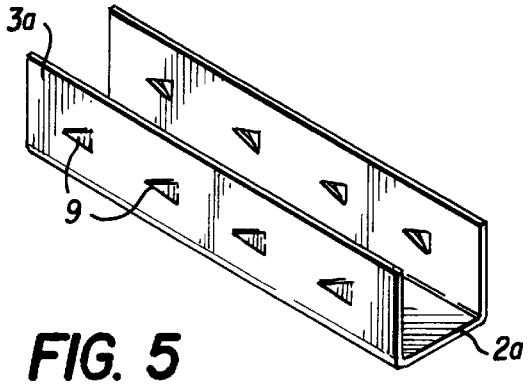
FIG. 5 shows a perspective view of another embodiment of the removable shield including means to retain the shield in operative position relative to the housing in the form of multiple protrusions extending outwardly from side surfaces of the body.

The present invention will now be described in greater detail with reference to the accompanying drawings. Referring to FIG. 1 which illustrates the prior art, a corona charging device like a dicorotron device is shown comprising anchors 31, between which is supported at least one elongated conductive corona discharge electrode or dicorotron wire 30 [hereinafter used interchangeably with electrode or wire] with the anchors secured to end blocks 35. A conductive shield 34 is slidably mounted and supported by the bottom of housing 39 and is constructed in a 8 rectangular tubular cross-sectional configuration. Handle 36 facilitates the sliding movement. When inserted into the housing, the conductive shield 34 is fastened in place with the aid of spring retaining member 38. A machine high voltage contact pin 33 serves as an electrical contact to provide connection to an AC power supply. Extending from the housing are two vertical side panels 32 formed for the entire length of the dicorotron wire.

The outer portion and inner surfaces of conductive shield 34 are coated with an electrically conductive dry film of aluminum hydroxide containing graphite and nickel powder. A similar film 40 also resides on the side panels such that the side panels and the top portion of the conductive shield form a conductive cavity 41 having a longitudinal opening at the top thereof. Shield 34 and coating 40 are at the same voltage potential. This conductive cavity substantially surrounds the dicorotron wire 30 and has a generally U-shaped cross-sectional configuration. FIG. 1 of U.S. Pat. No. 4,290,266 illustrates a conductive surface on one side of dicorotron wire or electrode.

FIG. 2 shows a perspective view of the removable shield means 1 [hereinafter referred to as removable shield] of the present invention. The removable shield means comprises a body 2 having a generally U-shaped cross-sectional configuration which fits within the cavity of the housing and includes tab means 5. The body includes a lower surface 4 which is in electrical contact with the conductive shield 34 as shown in FIG. 3 when the removable shield is inserted into the conductive cavity. The side surfaces 3 on the exterior of the body are disposed adjacent to sides 32 and may be in electrical contact with the film 40 adhered to sides 32 of the housing when the removable shield is inserted into the conductive cavity 41. Electrode 30 must be removed before the shield is inserted into the housing cavity.

A space 6 is defined between conductive shield 34 and at least one side 32 of the housing. For the length of the conductive cavity, this space appears as a channel. The space 6 may not be readily apparent from FIG. 1, but is more clearly defined in FIG. 3.

The body of the removable shield may be formed of a material selected from metal, a metal composition or a coating upon metal that retards absorption of nitrogen oxide species that are generated when a negative corona is produced by the electrode. Metal materials that are suitable candidates include, among others, titanium, gold and platinum. Otherwise, any suitable metal with a composition of the prior art may be utilized to manufacture the body as long as it neutralizes nitrogen oxide species.

The removable shield should be made as thin as possible due to the expense associated with the metal or metal compositions selected. The body of the removable shield should not be as thin as a foil since this would not be rigid enough to be inserted into the conductive cavity. The removable shield should be manufactured to a thickness where it is bendable into the generally U-shaped configuration and where it will hold its physical shape and integrity when inserted into the conductive cavity. As a general guideline, if the body of the removable shield in the range of 2–3 mils thick results in a foil, the shield should be constructed with thickness uniform throughout the body and greater than 3 mils.

As seen from FIG. 3, the removable shield substantially encloses the electrode. This configuration allows the removable shield to act as a bias for ions, either repelling or attracting them depending upon the voltage applied to the conductive shield 34. Moreover, the removable shield also protects the plastic housing. Functionally at the molecular level, the removable shield traps the nitrogen oxide species when a negative corona is generated. Ideally, the removable shield adsorbs nitrogen oxide species readily, but desorbs at rate slow enough to release trapped or adsorbed species so as not to interact with the chemistry to thereby affect the quality of the printing as discussed previously concerning the parking deletion phenomena. When operating in this ideal manner, the removable shield works most effectively to neutralize the nitrogen oxide species.

There are a variety of ways to retain the shield in operative position within the housing.

In a first embodiment as shown in FIG. 2, the removable shield includes tab means 5 extending therefrom for reception in space 6. It should be appreciated that the dimensions of space 6 serves as a parameter from which the tab means must be manufactured to a degree of accuracy for being received and accommodated within this space. The tabs means 5 include a surface 5*a* which is coplanar with one of the side surfaces 3 of the body or housing sides 32 as in FIG. 3.

In a second embodiment, the tab means 5 may be a plurality of plastic tabs 8 attached to surface 4 so as to be received by space 6 as shown in FIG. 4. Although these tabs 8 may be adhesively adhered, soldered or co-molded in position as illustrated in FIG. 4, any feasible or known manner of attaching such tabs would suffice. The tabs are a means for retaining the body in operative position relative to the housing, while allowing for easy removal and servicing of the corona generating device.

For a third embodiment shown in FIG. 5, means for retaining the body in operative position relative to the housing is in the form of multiple protrusions 9 extending outwardly from the side surfaces 3*a* of the body 2*a*. These protrusions frictionally engage the two sides 32 through coating 40 of the housing when the removable shield is inserted into the conductive cavity through the longitudinal opening. The protrusions may be pre-punched upon manufacture or fabrication of the removable shield. Alternately, the protrusion may be punched out with a sharp-point instrument such as a pair of scissors or screw-driver by a technician or an unskilled person installing the removable shield or servicing the corona charging device. The frictional fit would be of sufficient tightness to allow removal and replacement easily.

Figure 6:
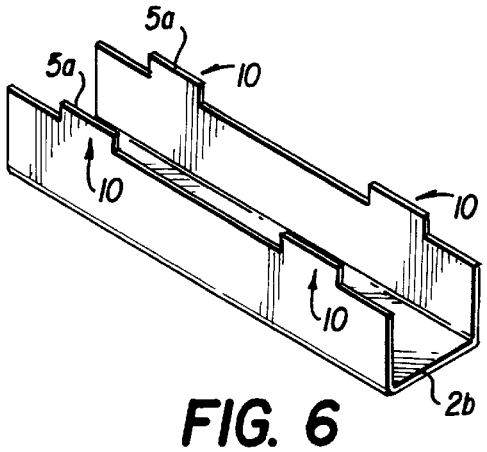
FIG. 6 shows a perspective view of another embodiment of the removable shield including means to retain the shield in operative position relative to the housing in the form of spaced-apart tabs extending from the outer edges of the sides of the removable shield.
Figure 7:
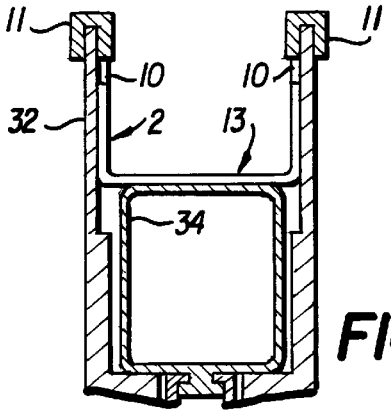
FIG. 7 is a cross-sectional view of taken along line 3—3 of the dicorotron of FIG. 1 with the removable shield of FIG. 6 inserted into the conductive cavity.

In a fourth embodiment shown in FIG. 6, the tab means 5*a* for retaining the body in operative position relative to the housing comprises four spaced tabs 10 extending from the outer edges of the sides of the removable shield. Tabs 10 may be integral with the body 2*b* of the removable shield and will frictionally engage lip elements 11 shown in FIG. 7. The lip elements may be fabricated as part of the housing or may be clip-on components attached longitudinally to the housing as shown in FIG. 7. The person servicing the corona generating device would force fit the tabs 10 under lip elements 11. The force fit would nevertheless be of sufficient tightness to allow removal and replacement easily. Portion 13 of body 2*b* should be manufactured so as to be flexible and allow the person installing the removable shield to snap the body into the conductive cavity. The fit would be of sufficient tightness to allow removal and replacement easily.

Figure 8:
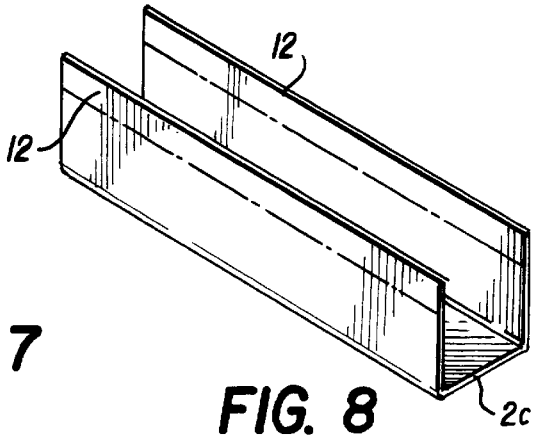
FIG. 8 shows a perspective view of another embodiment of the removable shield including means to retain the shield in operative position relative to the housing in the form of force fitting the shield to frictionally engage lip elements of the housing shown in FIG. 7.
Figure 9:
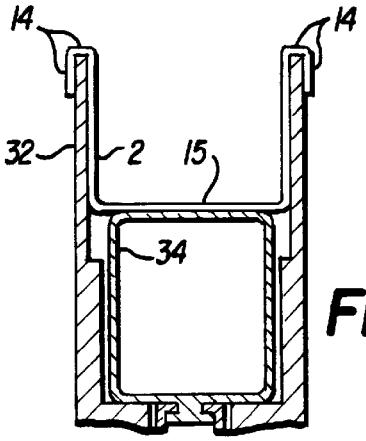
FIG. 9 is a cross-sectional view of another embodiment of the removable shield including means to retain the shield in operative position relative to the housing in the form of tabs bent over upper edges of the sides of the housing.

In a fifth embodiment, FIG. 8 comprises a removable shield manufactured to be force fit into the conductive cavity to retain the body in operative position. Outer edges 12 of body 2*c* are adapted to frictionally engage lip elements 11 on the housing similar to tabs 10 shown in FIG. 7. In a sixth embodiment, FIG. 9 shows an alternate means for retaining the body in operative position relative to the housing. Tabs 14 are to be bent over the upper edges of sides 32 of the housing. An unskilled operator installing the removable shield would bend tabs 14 over the upper edges of the sides of the housing so that the removable shield remains in operative position within the conductive cavity. At least portion 15 of the body must be in electrical contact with conductive shield 34.

Figure 10:
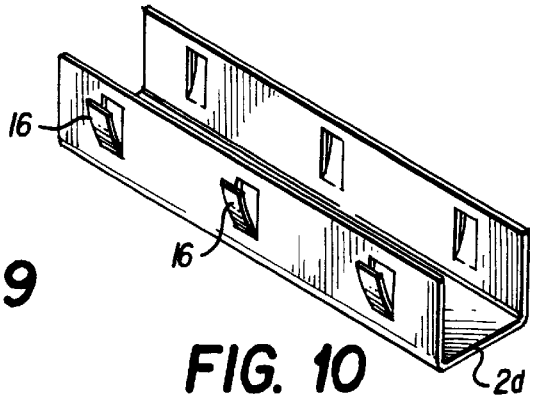
FIG. 10 shows a perspective view of another embodiment of the removable shield including means to retain the shield in operative position relative to the housing in the form of pressure-loadable clips attached to the body of the removable shield.

Other means for retaining the body in operative position relative to the housing may include utilizing pressure-loadable clips 16 supported by the body 2*d* removable shield to engage the sides of the housing when the removable shield is inserted through the longitudinal opening, as shown in FIG. 10.

Although particular embodiments of the invention have been described in detail herein with reference to the accompanying drawings, it is to be understood that the invention is not limited to those precise embodiments, and that various changes and modifications may be effected therein by one skilled in the art without departing from the scope or spirit of the invention as defined in the appended claims.

I claim:

1. A corona generating device with removable shield comprising, a housing, at least one elongated conductive corona discharge electrode supported by said housing, a first conductive shield supported by said housing and defining a conductive surface on one side of said electrode, said housing including a pair of sides adjacent said conductive shield and defining a longitudinal opening at the opposite side of said electrode, and a removable shield comprising a body formed of a metal that retards absorption of nitrogen oxide species that are generated when negative corona is produced by said electrode, said body including a first surface in electrical contact with the conductive surface of said first conductive shied, said body also having a pair of side surfaces disposed adjacent the pair of sides of said housing, said removable shield being removable from and insertable into from said housing through said longitudinal opening, and means for retaining said body in operative position relative to said housing.

2. A corona generating device as defined in claim 1, wherein a space is defined between said first shield and one side of said housing, said means for retaining said body in operative position including tab means extending from said body for reception in said space.

3. A corona generating device as defined in claim 2, wherein said tab means includes a plurality of spaced tabs.

4. A corona generating device as defined in claim 1, wherein said means for retaining said body in operative position relative to said housing comprises tight frictional engagement between the side surfaces of said body and the pair of sides of said housing.

5. A corona generating device as defined in claim 1, wherein said means for retaining said body in operative position relative to said housing comprises a plurality of protrusions extending outwardly from said side surfaces, said protrusions frictionally engaging said pair of sides of the housing when the removable shield is inserted through the longitudinal opening.

6. A corona generating device as defined in claim 1, wherein said means for retaining said body in operative position relative to said housing comprising a plurality of tabs punched from the removable shield so that the tabs are coplanar with at least one of said side surfaces of the body.

7. A corona generating device as defined in claim 1, wherein the pair of sides of the housing include outer edges, said means for retaining said body in operative position relative to said housing comprising a plurality of tabs extending from the side surfaces of the body and bent over and engaging said outer edges.

8. A corona generating device as defined in claim 1, wherein said means for retaining said body in operative position relative to said housing comprising pressure-loadable clips supported by the removable shield for engaging said pair of sides when the removable shield is inserted through the longitudinal opening.

9. A corona generating device as defined in claim 1, wherein the pair of sides define lip elements along an outer edge of the longitudinal opening, said means for retaining said body in operative position relative to said housing comprising spaced portions of said removable shield in frictional engagement with said lip elements when the removable shield is inserted into the longitudinal opening.

10. A corona generating device with removable shield means comprising, a housing said housing including spaced generally parallel side panels defining a cavity therebetween a conductive shield having a generally rectangular tubular cross-sectional area, said conductive shield being positioned within said cavity, an elongated conductive corona discharge electrode disposed within said cavity, removable shield means having a generally U-shaped cross-sectional configuration including a pair of spaced sides and being insertable into and removable from said cavity after the electrode is removed from said cavity, and means for retaining said removable shield means in operative position relative to said housing.

11. A corona generating device according to claim 10, wherein the removable shield means comprises a body formed of a metal that retards absorption of nitrogen oxide species that are generated when negative corona is produced by said electrode.

* * * * *